US008303284B2

(12) United States Patent
Tsujimoto et al.

(10) Patent No.: US 8,303,284 B2
(45) Date of Patent: Nov. 6, 2012

(54) APPARATUS FOR PRODUCING POROUS BODY AND METHOD FOR PRODUCING POROUS BODY

(75) Inventors: Tetsuji Tsujimoto, Kitamoto (JP); Takumi Shibuya, Ageo (JP); Hiroki Ueno, Ageo (JP); Sakae Akiyama, Kurihashi-machi (JP); Masahiro Wada, Ageo (JP)

(73) Assignee: Mitsubishi Materials Corporation, Tokyo (JP)

( * ) Notice: Subject to any disclaimer, the term of this patent is extended or adjusted under 35 U.S.C. 154(b) by 297 days.

(21) Appl. No.: 12/446,625

(22) PCT Filed: Oct. 23, 2007

(86) PCT No.: PCT/JP2007/070627

§ 371 (c)(1),
(2), (4) Date: Apr. 22, 2009

(87) PCT Pub. No.: WO2008/050753

PCT Pub. Date: May 2, 2008

(65) Prior Publication Data

US 2010/0289167 A1 Nov. 18, 2010

(30) Foreign Application Priority Data

Oct. 23, 2006 (JP) ..... 2006-287953

(51) Int. Cl.
*B29C 44/16* (2006.01)

(52) U.S. Cl. ..... 425/4 C; 425/101; 425/115; 425/200; 425/224; 425/817 C

(58) Field of Classification Search ..... 425/4 C, 425/89, 90, 94, 99, 101, 104, 110, 115, 130, 425/133.1, 133.5, 134, 200, 209, 224, 376.1, 425/377, 462, 542, 817 C
See application file for complete search history.

(56) References Cited

U.S. PATENT DOCUMENTS 1,785,457 A * 12/1930 Pfohl ..... 425/192 R
(Continued)

FOREIGN PATENT DOCUMENTS

EP 0765704 4/1997
(Continued)

OTHER PUBLICATIONS

European Search Report mailed Feb. 3, 2012 for the corresponding European Patent Application No. EP 07 83 0361.

*Primary Examiner* — Joseph Del Sole
*Assistant Examiner* — Seyed Masoud Malekzadeh
(74) *Attorney, Agent, or Firm* — Leason Ellis LLP.

(57) ABSTRACT

An apparatus for producing a porous body that forms an expandable slurry containing at least inorganic powder, a foaming agent, and a binder into a sheet, causes the expandable slurry sheet to be foamed and baked, and thereby produces the porous body, the apparatus includes: a mixer preparing the expandable slurry by containing inorganic powder, a foaming agent, and a binder; a die-coater that has a discharge opening which discharges the expandable slurry provided from the mixer to an external thereof so as to shape the expandable slurry into a sheet; and a carrier sheet arranged so as to face the discharge opening of the die-coater with a gap interposed therebetween, and feeding the expandable slurry discharged from the discharge opening, wherein a flow path of the expandable slurry from inside the mixer to the discharge opening of the die-coater is hermetically sealed from an outside.

4 Claims, 2 Drawing Sheets

U.S. PATENT DOCUMENTS

| | | | | | |
|---|---|---|---|---|---|
| 2,912,738 | A | * | 11/1959 | Bergling et al. | 425/89 |
| 2,985,219 | A | * | 5/1961 | Summerfield | 156/39 |
| 3,205,116 | A | * | 9/1965 | Walsh et al. | 156/500 |
| 3,278,659 | A | * | 10/1966 | Willy | 264/54 |
| 3,343,818 | A | * | 9/1967 | Plemous et al. | 366/3 |
| 3,454,688 | A | * | 7/1969 | Bloom et al. | 264/42 |
| 3,493,644 | A | * | 2/1970 | Owen | 264/148 |
| 3,532,576 | A | * | 10/1970 | Hakes et al. | 156/348 |
| 3,929,947 | A | * | 12/1975 | Schwartz et al. | 264/42 |
| 4,038,063 | A | * | 7/1977 | Williams et al. | 65/22 |
| 4,086,045 | A | * | 4/1978 | Thiel et al. | 425/326.1 |
| 4,221,555 | A | * | 9/1980 | Boon | 425/89 |
| 4,354,810 | A | * | 10/1982 | Stidham | 425/91 |
| 4,374,079 | A | * | 2/1983 | Fouss et al. | 264/46.1 |
| 4,443,397 | A | * | 4/1984 | Hahn et al. | 264/173.12 |
| 4,572,865 | A | * | 2/1986 | Gluck et al. | 428/309.9 |
| 4,764,420 | A | * | 8/1988 | Gluck et al. | 428/317.7 |
| 4,986,744 | A | * | 1/1991 | Weisweiler et al. | 425/94 |
| 5,011,393 | A | * | 4/1991 | Nakanishi | 425/89 |
| 5,456,586 | A | * | 10/1995 | Carson | 425/4 R |
| 5,679,381 | A | * | 10/1997 | Andersen et al. | 425/104 |
| 5,916,928 | A | * | 6/1999 | Sessions et al. | 521/155 |
| RE36,674 | E | * | 4/2000 | Gluck et al. | 428/308.4 |
| 6,604,336 | B2 | * | 8/2003 | Bane et al. | 52/745.19 |
| 6,699,426 | B1 | * | 3/2004 | Burke | 264/426 |
| 6,742,922 | B2 | * | 6/2004 | Shrader et al. | 366/2 |
| 7,172,403 | B2 | * | 2/2007 | Burke | 425/4 R |
| 7,186,102 | B2 | * | 3/2007 | Laver et al. | 425/4 C |
| 2002/0171164 | A1 | * | 11/2002 | Halterbaum et al. | 264/53 |

FOREIGN PATENT DOCUMENTS

| | | | |
|---|---|---|---|
| EP | 0 949 028 | A1 | 10/1999 |
| EP | 1 633 010 | A1 | 3/2006 |
| JP | 57-165160 | | 10/1982 |
| JP | 06-000223 | | 1/1994 |
| JP | 11-314060 | | 11/1999 |
| JP | 3282497 | | 3/2002 |
| JP | 2006-142622 | | 6/2006 |

* cited by examiner

APPARATUS FOR PRODUCING POROUS BODY AND METHOD FOR PRODUCING POROUS BODY

CROSS-REFERENCE TO PRIOR APPLICATION

This is the U.S. National Phase Application under 35 U.S.C. §371 of International Patent Application No. PCT/JP2007/070627 filed Oct. 23, 2007, which claims the benefit of Japanese Patent Application No. 2006-287953 filed Oct. 23, 2006, both of them are incorporated by reference herein. The International Application was published in Japanese on May 2, 2008 as WO2008/050753 A1 under PCT Article 21(2).

BACKGROUND OF THE INVENTION

1. Field of the Invention

The present invention relates to an apparatus for producing a sheet-like porous body having a three-dimensional net structure and a method for producing a porous body.

This application claims priority from Japanese Patent Application No. 2006-287953 filed on Oct. 23, 2006, the contents of which are incorporated herein by reference in their entirety.

2. Background Art

Conventionally, when a sheet-like porous body that is used for a filter, a gas diffusion member, a heat radiation member, a water absorption member, or the like is produced, an expandable slurry including an inorganic powder, a foaming agent, an organic binder, a liquid solvent, or the like is shaped in a sheet, thereafter, the expandable slurry is foamed using a foaming agent, and the expandable slurry that has been foamed is furthermore dried and baked, as described in, for example, Japanese Patent Publication No. 3282497.

When shaping the expandable slurry into a sheet, the expandable slurry is passed between a carrier sheet constituting a belt conveyer and transferring the expandable slurry, and a doctor blade disposed at an upper portion thereof.

Here, an opened chamber accumulating the expandable slurry is disposed at an upstream side of the doctor blade.

An upper portion of the opened chamber is opened in an atmosphere, and the expandable slurry can be provided to the opened chamber.

In the case of shaping the expandable into a sheet as described above, by intermittently or continuously providing the expandable slurry to the opened chamber, it is possible to continuously shape an expandable slurry sheet for a long period of time.

However, the expandable slurry that has been provided to the opened chamber includes air bubbles. Since the upper portion of the opened chamber is opened in an atmosphere, the air bubbles are accumulated by an ascending force at the upper portion of the opened chamber.

Specifically, when continuously shaping the expandable slurry sheet for a long period of time, the size of the air bubbles become large which is caused by joining the air bubbles that have been accumulated at the upper portion.

When the number of air bubbles whose size become large increases, there is a problem in that these air bubbles whose size became large passes between the carrier sheet and the doctor blade.

Consequently, in the expandable slurry sheet that has been shaped so as to include air bubbles whose size became large, since variations in the size of the air bubbles easily occur, there is a problem in that distribution of air bubbles in the porous body becomes uneven.

SUMMARY OF THE INVENTION

The invention was made in view of the above-described situation, and has an object to provide an apparatus and a method for producing a porous body, where it is possible to evenly maintain distribution of air bubbles in the porous body even if the expandable slurry is continuously formed into a sheet for a long period of time.

In order to achieve the above-described object, the invention provides an apparatus and a method described below.

A first aspect of the invention provides an apparatus for producing a porous body that forms an expandable slurry containing at least inorganic powder, a foaming agent, and a binder into a sheet, causes the expandable slurry sheet to be foamed and baked, and thereby produces the porous body. The apparatus includes: a mixer preparing the expandable slurry by containing inorganic powder, a foaming agent, and a binder; a die-coater used for shaping, that has a discharge opening which discharges the expandable slurry provided from the mixer to an external thereof so as to shape the expandable slurry into a sheet; and a carrier sheet arranged so as to face the discharge opening of the die-coater with a gap interposed therebetween, and feeding the expandable slurry discharged from the discharge opening. In the apparatus, a flow path of the expandable slurry from inside the mixer to the discharge opening of the die-coater is hermetically sealed from the outside.

In this apparatus for producing a porous body, since the expandable slurry that has been discharged on the carrier sheet from the discharge opening of the die-coater passes the gap between the discharge opening and the carrier sheet, the expandable slurry sheet having the thickness in accordance with the size of the gap is formed.

In the case where the expandable slurry sheet is formed in this manner, by continuously discharging the expandable slurry from the discharge opening of the die-coater, it is possible to continuously form the expandable slurry sheet for a long period of time.

Another aspect of the invention provides an apparatus for producing a porous body, that is configured so that powdered slurry in which the inorganic powder and the binder are mixed is prepared and deaerated, the powdered slurry and the foaming agent are provided to the mixer and mixed in the mixer, the expandable slurry is thereby prepared, and a gas incorporation means that incorporates a gas whose amount is controlled into the deaerated powdered slurry or into the expandable slurry in the mixer is provided.

Another aspect of the invention provides, an apparatus for producing a porous body, that is configured so that a flow path of the powdered slurry from a slurry tank storing the deaerated powdered slurry to the mixer is hermetically sealed from the outside.

Another aspect of the invention provides, an apparatus for producing a porous body includes a mohno pump squeezing the expandable slurry into the discharge opening of the die-coater from inside the mixer.

Another aspect of the invention provides, an apparatus for producing a porous body includes a linear pump squeezing the expandable slurry into the discharge opening of the die-coater from inside the mixer.

Another aspect of the invention provides a method for producing a porous body that forms an expandable slurry containing at least inorganic powder, a foaming agent, and a binder into a sheet, causes the expandable slurry sheet to be foamed and baked, and thereby produces the porous body. The method includes: making the expandable slurry not to be exposed to an atmosphere until the expandable slurry is formed into a sheet after preparing the expandable slurry by the inorganic powder, the foaming agent, and the binder.

Another aspect of the invention provides a method for producing a porous body, in which the expandable slurry is prepared by mixing the powdered slurry and the foaming agent after the powdered slurry formed by mixing the inorganic powder and the binder is deaerated, and a gas is incorporated into the powdered slurry or into the expandable slurry between after the powdered slurry is deaerated and before the expandable slurry is formed into the sheet, an amount of the gas being controlled.

According to the invention, the expandable slurry is not exposed to an atmosphere until the expandable slurry reaches the discharge opening from inside the mixer, that is, until the expandable slurry is formed into a sheet after the expandable slurry is prepared. Therefore, even if air bubbles are included in the prepared expandable slurry, it is possible to prevent the size of air bubbles from becoming large which is caused by joining the air bubbles until the expandable slurry is formed into a sheet.

Therefore, even if the expandable slurry sheet is continuously formed for a long period of time, variations in the size of the air bubbles that are foamed in the expandable slurry is prevented, and it is possible to evenly maintain the distribution of air bubbles in the porous body that is obtained by baking the expandable slurry.

In foam formation of the expandable slurry, air bubbles included in the expandable slurry are grown by a foaming agent. As described above, by controlling the amount of the gas incorporated into the deaerated powdered slurry or into the expandable slurry including the deaerated powdered slurry, it is possible to control the amount of air bubbles included in the expandable slurry.

Therefore, it is possible to easily control the capacity of the air bubbles that have been grown due to foam formation, and the porosity of the porous body can be easily controlled.

In addition, in the case where the flow path of the expandable slurry from a slurry tank to the mixer is hermetically sealed from the outside, since it is possible to reliably prevent unexpected gasses from incorporating into the powdered slurry which is caused by exposing the powdered slurry to an atmosphere, it is possible to specifically control the porosity of the porous body with a high level of precision.

In addition, in the ease of using the mohno pump or the linear pump, since it is possible to prevent pulsation from being generated in the expandable slurry that is squeezed into the discharge opening from inside the mixer, it is possible to reliably prevent the air bubbles included in the expandable slurry from joining until the expandable slurry reaches the discharge opening of the die-coater.

According to the invention, even if the expandable slurry sheet is continuously formed for a long period of time, it is possible to evenly maintain the distribution of air bubbles in the porous body.

DESCRIPTION OF THE PREFERRED EMBODIMENTS

Hereinafter, an apparatus for producing a porous body of an embodiment of the invention will be described with reference to FIGS. 1 and 2.

Figure 1:
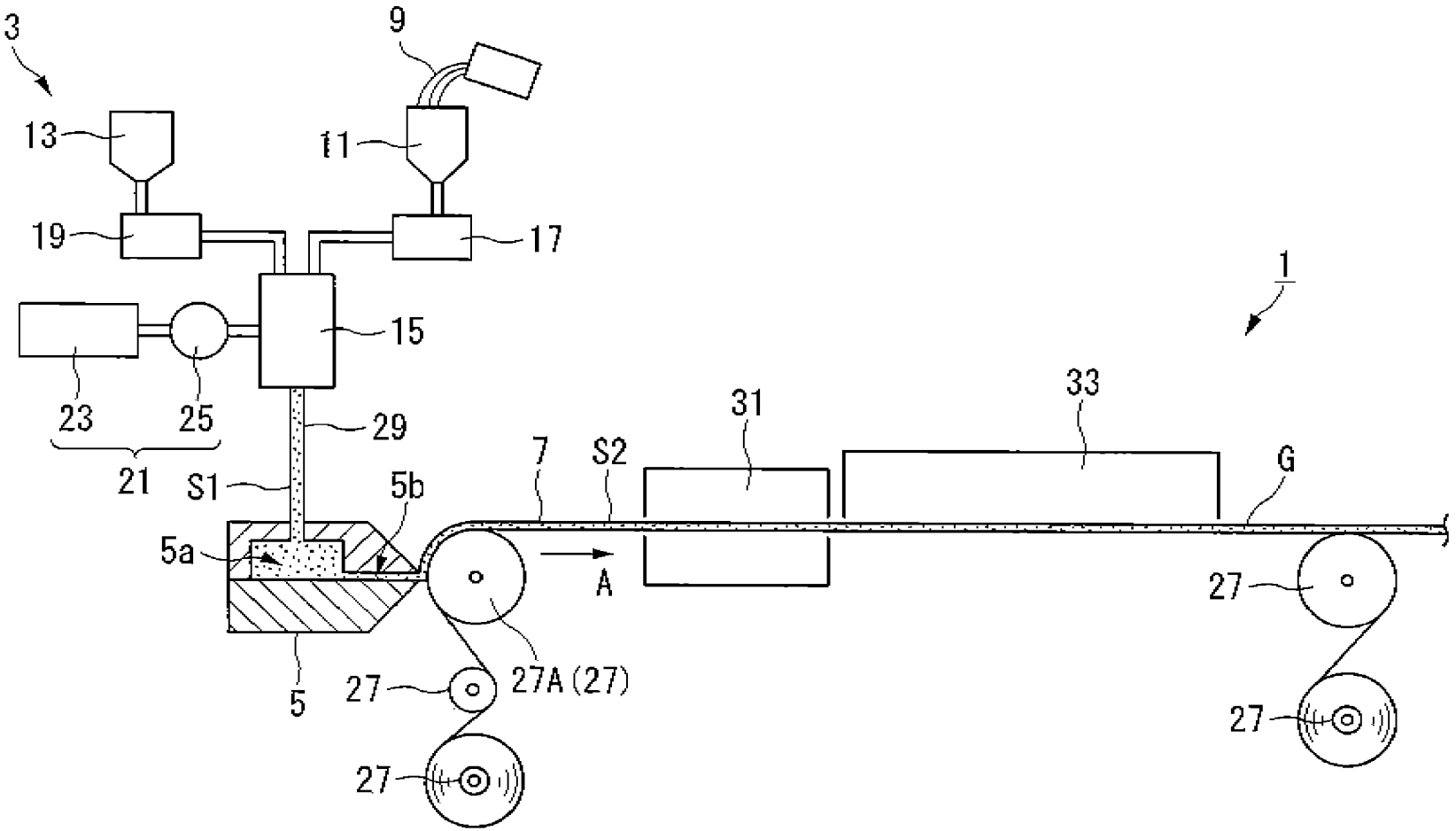
FIG. 1 is a schematic cross-sectional view showing a porous body producing apparatus of an embodiment of the invention.
Figure 2:
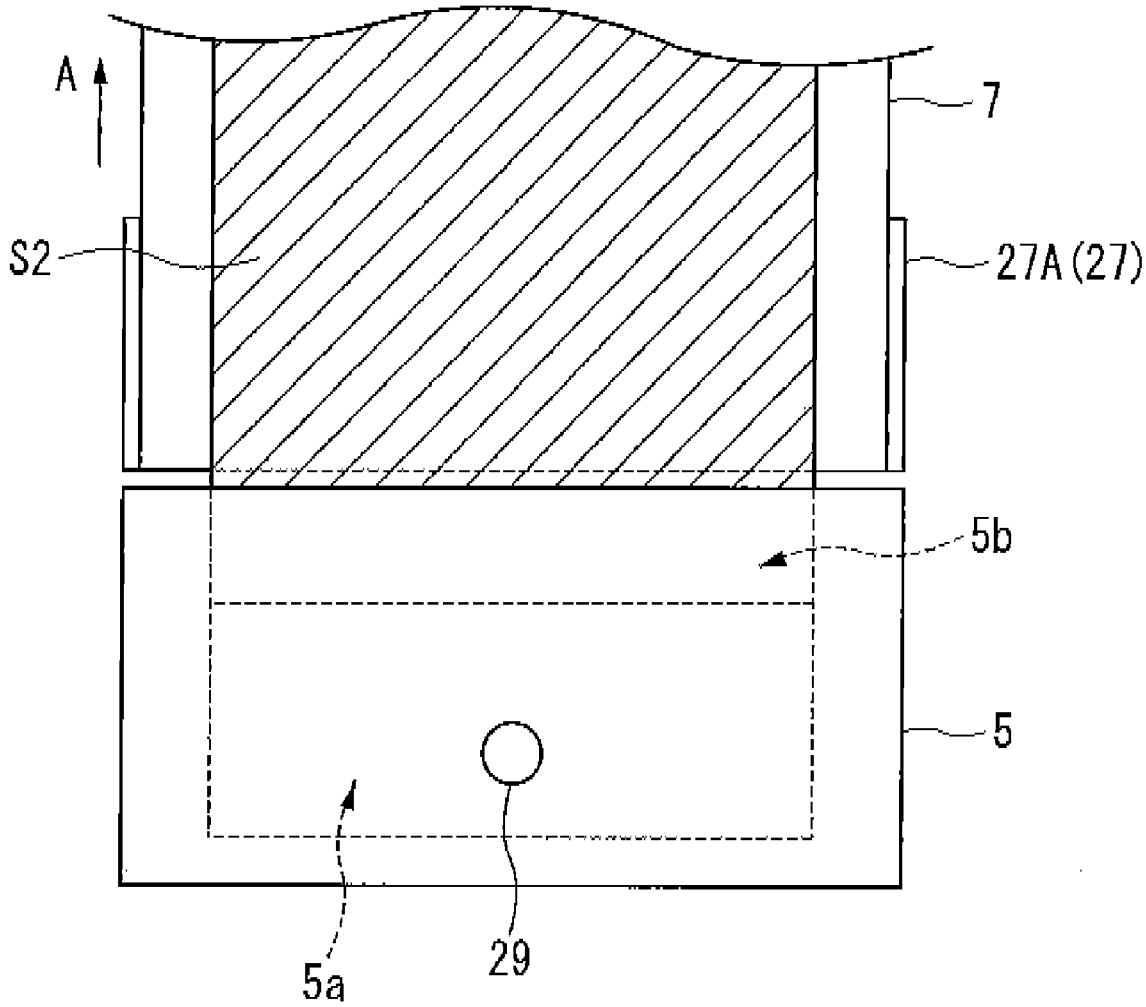
FIG. 2 is a schematic plan view showing a die-coater in the apparatus for producing a porous body show in FIG. 1.

As shown in FIG. 1, a porous body producing apparatus 1 forms an expandable slurry S1 containing metal powder (inorganic powder), a foaming agent, a organic binder (binder), a liquid solvent (binder), or the like into a sheet, produces a green sheet G that is obtained by foaming and drying the expandable slurry sheet (hereinafter, refer to expandable slurry sheet S2), further degreases and bakes this green sheet G, and thereby produces a porous sheet having a three-dimensional net structure.

Here, as metal powder contained in the expandable slurry S1, for example, nickel, copper, iron, SUS, chrome, cobalt, gold, silver, or the like are adopted, but any of metal that can be powderized and sintered can be used.

In addition, as the foaming agent, for example, an organic solvent medium of non-water soluble hydrocarbon system (e.g., neopentane, hexane, and heptane) or the like which has five to eight carbon atoms is adopted. A foaming agent that can cause air bubbles in the expandable slurry S1 to be grown by at least generating gas may be adopted. A variety of compounds or a volatile organic solvent medium that is decomposed at a predetermined temperature and generates a gas can be used as the foaming agent.

Furthermore, as the organic binder, a water soluble organic binder such as methylcellulose, hydroxypropyl methylcellulose is adopted, but an organic binder that functions to maintain the form of the green sheet when the expandable slurry sheet S2 is at least dried can be used.

In addition, water is adopted as the liquid solvent, but the liquid solvent which can volatilize in an atmosphere by being heated at least at a high temperature, whose volatility is lower than that of the foaming agent, and whose boiling point is higher than that of the foaming agent, can be used.

Moreover, it is preferable that an expandable slurry disclosed in, for example, Japanese Patent Publication No. 3282497 be used as the expandable slurry S1.

The porous body producing apparatus 1 is provided with a kneading unit 3 that prepares the expandable slurry S1, a die-coater 5 that is used for shaping and discharges the expandable slurry S1 provided from the kneading unit 3 to an external thereof, and a carrier sheet 7 feeding the expandable slurry S1 that has been discharged from the die-coater 5.

Furthermore, the kneading unit 3 is provided with a slurry tank 11 storing powdered slurry 9 that is prepared by kneading the metal powder except for the foaming agent, the organic binder, the liquid solvent, or the like, a foaming agent tank 13 that stores the foaming agent, and a mixer 15 that stores the powdered slurry 9 and the foaming agent and prepares the expandable slurry S1 by kneading the powdered slurry 9 and the foaming agent.

Moreover, the powdered slurry 9 provided to the slurry tank 11 has been deaerated.

A first squeeze pump 17 that squeezes the powdered slurry 9 into the mixer 15 from the slurry tank 11 is provided between the slurry tank 11 and the mixer 15.

This first squeeze pump 17 causes the squeezed powdered slurry 9 not to generate pulsation. As the first squeeze pump 17, for example, a mohno pump or a linear pump is adopted.

In addition, a flow path of the powdered slurry 9 from the slurry tank 11 to the mixer 15 through the first squeeze pump 17 is hermetically sealed from the outside.

In addition, a second squeeze pump 19 that squeezes the foaming agent into the mixer 15 from the foaming agent tank 13 is also provided between the foaming agent tank 13 and the mixer 15.

In a manner similar to the first squeeze pump 1, the second squeeze pump 19 causes the squeezed powdered slurry 9 not to generate pulsation. As the second squeeze pump 19, for example, a mohno pump or a linear pump is adopted.

In addition, a flow path of the foaming agent from the foaming agent tank 13 to the mixer 15 through the second squeeze pump 19 is hermetically sealed from the outside.

In addition, the kneading unit 3 is further provided with a gas incorporation means 21 that incorporates a gas whose amount is controlled into the expandable slurry S1 in the mixer 15. This gas incorporation means 21 is constituted of, for example, a gas supply section 23 that provides a gas into the mixer 15 and is a compressor or the like, a flow monitor 25 that measures flow rate of the gas flowing into the mixer 15 from the gas supply section 23, and a uniformization mechanism (not shown) that evenly incorporates the gas that has been flowed into the mixer 15 by agitating or vibrating into the expandable slurry S1.

Therefore, the gas incorporated into the expandable slurry S1 by the gas incorporation means 21 exists in the expandable slurry S1 as micro air bubbles so as to be evenly distributed.

In addition, in this structure, by controlling the operation of the gas supply section 23 based on the amount of the powdered slurry 9 and the foaming agent provided to the mixer 15 and based on the measurement value measured by the flow monitor 25, it is possible to set the capacity ratio of the gas incorporated into the expandable slurry S1 in the mixer 15 as a desired value.

That is, it is possible to control the amount of air bubbles included in the expandable slurry S1.

The carrier sheet 7 is constituted of a film or the like made of, for example, PET, and is fed along a longitudinal direction thereof (direction A) by a plurality of rollers 27.

In addition, the die-coater 5 is disposed so as to face a roller 27A arranged at upstream side of the feeding direction (direction A) of the carrier sheet 7, and has a structure disclosed in, for example, Japanese Unexamined Patent Application, First Publication No. H11-314060 or Japanese Examined Patent Application, Second Publication No. H06-223.

That is the die-coater 5 is provided with a manifold 5*a* serving as a space in which the expandable slurry S1 provided from the mixer 15 is spread toward a width direction of the roller 27A, and an elongated groove-like slit 5*b* (discharge opening) discharging the expandable slurry S1 as a sheet to an external thereof from this manifold 5*a*.

A communicating tube 29 that connects the inside of mixer 15 with the manifold 5*a* is provided between the mixer 15 and the die-coater 5. Therefore, the flow path of the expandable slurry S1 from the inside of the mixer 15 to an exit of the slit 5*b* of the die-coater 5 is hermetically sealed from the outside.

Moreover, the communicating tube 29 is connected with a central portion of the manifold 5*a* in the width direction thereof, and can evenly spread the expandable slurry S1 that has been provided from the communicating tube 29 to the manifold 5*a* toward the width direction of the manifold 5*a*.

Thus, the expandable slurry S1 in the mixer 15 is squeezed into the exit of the slit 5*b* of the die-coater 5 from the mixer 15 through the communicating tube 29 by the above-described two squeeze pumps 17 and 19.

In addition, the exit of the slit 5*b* is disposed so as to face to the carrier sheet 7 winded on the roller 27A with a gap interposed between the exit and the carrier sheet 7. When the expandable slurry S1 discharged on the carrier sheet 7 from the exit passes the gap between the exit of the slit 5*b* and the carrier sheet 7 in conjunction with feeding of the carrier sheet 7, the expandable slurry sheet S2 having the thickness in accordance with the size of this gap is formed.

Furthermore, this porous body producing apparatus 1 is provided with an expansion tank 31 and a heating furnace 33 disposed in order in the downstream side from the roller 27A in the feeding direction of the carrier sheet 7 and is configured so that the carrier sheet 7 and the expandable slurry sheet S2 pass through the expansion tank 31 and the heating furnace 33.

The expansion tank 31 advances the foam formation of the expandable slurry sheet S2 by heating the expandable slurry sheet S2 under a high-humidity atmosphere.

In addition, the heating furnace 33 forms the green sheet G by heating and drying the expandable slurry sheet S2 which has been foamed in the expansion tank 31.

Next, by the porous body producing apparatus 1 configured as described above, a method for producing a porous body will be described.

In the case of producing the porous body, firstly, the expandable slurry S1 including the metal powder, the foaming agent, the organic binder, liquid solvent, or the like is prepared (slurry preparation process).

In this process, the powdered slurry 9 is prepared by kneading the metal powder except for the foaming agent, the organic binder, the liquid solvent, or the like, and the deaerated powdered slurry 9 is provided to the slurry tank 11.

The deaerated powdered slurry 9 is provided to the mixer 15 by the first squeeze pump 17, and the foaming agent that is preliminarily stored in the foaming agent tank 13 is also provided to the mixer 15 by the second squeeze pump 19. In the mixer 15, the expandable slurry S1 is prepared by kneading the powdered slurry 9 and the foaming agent.

In addition, since the flow paths of the powdered slurry 9 or the foaming agent from the slurry tank 11 or the foaming agent tank 13 to the mixer 15 are hermetically sealed from the outside, that is, since the powdered slurry 9 or the foaming agent are not exposed to an atmosphere from the slurry tank 11 or the foaming agent tank 13 to the mixer 15, a gas is not incorporated into the powdered slurry 9 and the foaming agent that are provided to the mixer 15.

Furthermore, in this process, the gas supply section 23 provides the gas whose amount is controlled to the mixer 15, and incorporates the gas into the above-described expandable slurry S1.

The incorporated gas exists in the expandable slurry S1 as micro air bubbles so as to be evenly distributed.

In addition, the amount of the gas incorporated into the expandable slurry S1 is controlled so that the capacity ratio of gas relative to the expandable slurry S1 is a predetermined value (for example 10 to 25%).

Therefore, in the slurry preparation process, the expandable slurry including only the air bubble whose amount is controlled is prepared.

Next, the expandable slurry S1 that has been prepared as described above-described is formed into a sheet (formation process).

In this process, the expandable slurry S1 is squeezed into the slit 5*b* of the die-coater 5 from the mixer 15 by the two squeeze pumps 17 and 19, and continuously discharged from this slit 5*b* while feeding the carrier sheet 7 in the direction A. This expandable slurry S1 thereby passes the gap between the exit of the slit 5*b* and the carrier sheet 7, and the expandable slurry sheet S2 is continuously formed.

In addition, since the flow path of the expandable slurry S1 from the mixer 15 to the slit exit 5*b* of the die-coater 5 is hermetically sealed from the outside, the expandable slurry S1 is not exposed to an atmosphere until the expandable slurry S1 is formed into a sheet after preparing the expandable slurry S1 in the mixer 15.

Next, due to the foam formation, the formed expandable slurry sheet S2 is formed into a porous body (foam formation process).

In this process, the expandable slurry sheet S2 that is fed from the roller 27A side by the carrier sheet 7 is heated under a high-humidity atmosphere when the expandable slurry sheet S2 passes through the expansion tank 31.

In this time, due to heating the foaming agent, the micro air bubbles included in the expandable slurry sheet S2 are grown by the foaming agent, the expandable slurry sheet S2 is thereby formed into the porous body.

Moreover, since the heating in the expansion tank 31 is performed under a high-humidity atmosphere, it is possible to prevent the expandable slurry sheet S2 from being cracked with the foam formation as described above.

Furthermore, the green sheet G is produced by drying the expandable slurry sheet S2 that has been foamed (drying process).

In this process, by heating and drying the expandable slurry sheet S2 that is fed from the expansion tank 31 by the carrier sheet 7 when passing through the heating furnace 33, the liquid solvent included in the expandable slurry sheet S2 that has been foamed is thereby volatilized, the green sheet G in a state in that the metal powders are brought together by the organic binder is formed.

Finally, in a vacuum furnace that is provided to the porous body producing apparatus 1 and not shown, by degreasing and baking the green sheet G (baking process), the organic binder is removed and the metal powders are sintered, and the porous sheet having a three-dimensional net structure is obtained.

In addition, in the porous body producing apparatus 1, by continuously performing each of the above-described process, it is possible to continuously produce the porous sheet for a long period of time.

As described above, according to the porous body producing apparatus 1 and the method for producing the porous body in this embodiment, since the expandable slurry S1 is not exposed to an atmosphere until the expandable slurry sheet S2 is formed into a sheet after the expandable slurry S1 is prepared, it is possible to prevent the size of micro air bubbles from becoming large which is caused by joining the micro air bubbles.

Therefore, even if the expandable slurry sheet S2 is continuously formed for a long period of time, variations in the size of the air bubbles that are foamed in the expandable slurry S2 is prevented, and it is possible to evenly maintain the distribution of air bubbles in the porous body that is obtained by baking and drying the expandable slurry S2 that has been foamed.

In addition, by controlling the amount of the gas incorporated into the expandable slurry S1 that has been deaerated, it is possible to control the amount of air bubbles included in the expandable slurry S1. That is, since it is possible to control the capacity of the air bubbles that are grown by the foam formation, it is possible to easily control the porosity of the porous body.

Furthermore, by hermetically sealing the flow paths of the powdered slurry 9 or the foaming agent from the slurry tank 11 or the foaming agent tank 13 to the mixer 15, it is possible to specifically control the porosity of the porous body with a high level of precision since it is possible to reliably prevent unexpected gasses from incorporating into the powdered slurry 9 or the foaming agent.

In addition, in the case where the mohno pump or the linear pump is used as the squeeze pumps 17 and 19 that squeeze the powdered slurry 9, the foaming agent, and the expandable slurry S1, it is possible to reliably prevent the air bubbles included in the expandable slurry S1 from joining until the expandable slurry S1 reaches the exit of the slit 5*b* since it is possible to prevent pulsation from being generated in the expandable slurry S1 that is squeezed into the exit of the slit 5*b* of the die-coater 5 from the mixer 15.

In addition, the invention is not limited to the above-described embodiment, but various modifications may be made without departing from the spirit or scope of the invention.

That is, the deaerated powdered slurry 9 is provided to the slurry tank 11 in the above-described embodiment, but, for example, a deaerating means (not shown) deaerating the powdered slurry 9 may be directly connected to the mixer 15, and a flow path of the powdered slurry 9 from the deaerating means to the mixer 15 may be hermetically sealed from the outside.

In this case, since it is possible to further reliably prevent unexpected gasses from incorporating into the deaerated powdered slurry 9, it is possible to control the porosity of the porous body with a higher level of precision.

In addition, the gas incorporation means 21 is configured to incorporate gas whose amount is controlled into the expandable slurry S1 in the mixer 15, but, is not limited to this, for example, may be configured to incorporate the gas whose amount is controlled into the deaerated powdered slurry 9. Furthermore, the gas incorporation means 21 is not limited to the structure of the above-described embodiment, but, for example, may be configured to agitate the powdered slurry 9 while exposing to an atmosphere and to incorporate the gas into the powdered slurry 9 by this agitation, the amount of the gas being controlled.

In this case, since the amount of the gas incorporated into the powdered slurry 9 is proportional to the time for agitating the powdered slurry 9, it is possible to control the amount of gas incorporated into the powdered slurry 9 by determining the time for agitating.

Moreover, it is desirable that the powdered slurry 9, into which gas is incorporated, be supplied to mixer 15 in a state in that the powdered slurry 9 is not exposed to an atmosphere, the amount of the gas being controlled.

Furthermore, the foaming agent, and the expandable slurry S1 are not exposed to an atmosphere until the expandable slurry S1 is formed into a sheet after deaerating the powdered slurry 9 in the above-described embodiment, the powdered slurry 9. In the case where the amount of air bubbles included in the expandable slurry S1 is not controlled, it is necessary to cause the expandable slurry 51 not to be exposed to an atmosphere until the expandable slurry S1 is formed into a sheet after preparing the expandable slurry S1 in at least the mixer 15.

Even in this case, since it is possible to prevent the size of micro air bubbles from becoming large which is caused by joining the air bubbles until the prepared expandable slurry S1 is formed into a sheet, it is possible to evenly maintain the distribution of air bubbles in the porous body.

According to the invention, even if the expandable slurry sheet is continuously formed for a long period of time, it is possible to evenly maintain the distribution of air bubbles in the porous body.

Therefore, the invention is extremely useful industrially.

What is claimed is:

1. An apparatus for producing a porous body that forms an expandable slurry comprising:

a deaerating device for deaerating a powdered slurry that contains an inorganic powder and a binder;

a mixer for preparing an expandable slurry by mixing the deaerated powdered slurry and a foaming agent;

a die-coater for shaping the expandable slurry into a sheet, said die-coater having a discharge opening which discharges the expandable slurry provided from the mixer to an external thereof;

a carrier sheet arranged so as to face the discharge opening of the die-coater with a gap interposed therebetween, said carrier sheet feeding the expandable slurry discharged from the discharge opening, and a gas incorporation unit that controls an amount of gas incorporated into the deaerated powdered slurry, or into the expandable slurry in the mixer whereby the amount of bubbles included in the expandable slurry is controlled, wherein a flow path of the expandable slurry from inside the mixer to the discharge opening of the die-coater is hermetically sealed from outside the apparatus in order to prevent unexpected gasses from incorporating into the slurry whereby the porosity of the porous body with a high level of precision is controlled.

2. The apparatus according to claim 1, wherein a flow path of the powdered slurry from a slurry tank storing the deaerated powdered slurry to the mixer is hermetically sealed from an outside.

3. The apparatus according to claim 1, further comprising:

a mohno pump or a linear pump squeezing the expandable slurry into the discharge opening of the die-coater from inside the mixer.

4. The apparatus according to claim 1, wherein the gas incorporation unit is composed of a gas supply section and a flow monitor.

* * * * *